US007059376B2

(12) United States Patent
Tussinger

(10) Patent No.: US 7,059,376 B2
(45) Date of Patent: Jun. 13, 2006

(54) ROLLER BLIND DEVICE

(76) Inventor: Philipp Tussinger, Karlstrasse 2, Ettlingen, 76275 (DE)

( * ) Notice: Subject to any disclaimer, the term of this patent is extended or adjusted under 35 U.S.C. 154(b) by 0 days.

(21) Appl. No.: 11/036,597

(22) Filed: Jan. 14, 2005

(65) Prior Publication Data

US 2005/0161175 A1 Jul. 28, 2005

Related U.S. Application Data

(63) Continuation of application No. PCT/EP03/05383, filed on May 23, 2003.

(30) Foreign Application Priority Data

Jul. 18, 2002 (DE) ..... 102 32 536

(51) Int. Cl.
*E06B 3/38* (2006.01)

(52) U.S. Cl. ..... 160/98; 160/310

(58) Field of Classification Search ..... 160/98, 160/265, 267.1, 310, 26, 271, 274, 279
See application file for complete search history.

(56) References Cited

U.S. PATENT DOCUMENTS 1,121,898 A * 12/1914 Davis ..... 160/265
2,958,083 A * 11/1960 Shook et al. ..... 4/502
5,067,184 A * 11/1991 Last ..... 4/502
5,287,908 A * 2/1994 Hoffmann et al. ..... 160/121.1

* cited by examiner

*Primary Examiner*—Blair M. Johnson
(74) *Attorney, Agent, or Firm*—Martin Fleit; Paul D. Bianco; Fleit Kain Gibbons Gutman Bongini & Bianco

(57) ABSTRACT

A roller blind device including a fabric, which can be wound on a rotationally drivable fabric shaft that is mounted on a frame, and including a pull rod that is placed on the free edge of the fabric. Prior art roller blind devices reduce the window surface area. The aim of the invention is to further develop a prior art roller blind device in order to obtain a simple, inexpensive and compact design that reduces the incidence of light only minimally. To this end, the invention provides that a cord reel is connected to the fabric shaft in a rotationally fixed manner while being coaxial to said fabric shaft and located in the extension thereof, and the free end of the cord that can be wound on the reel is connected to the pull rod via a cord diverter. When the fabric is pulled from the fabric shaft, the cord is wound on the cord reel and vice versa. A spring device is provided over the course of the cord in order to adapt the cord to the varying winding state of the fabric shaft and cord reel.

5 Claims, 6 Drawing Sheets

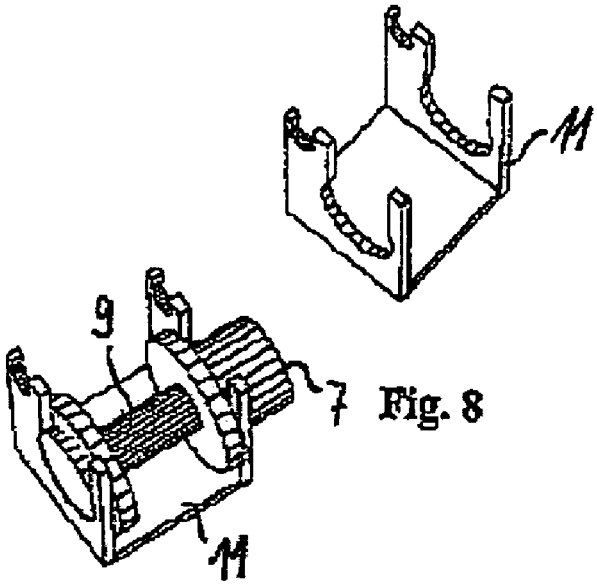
Fig. 8
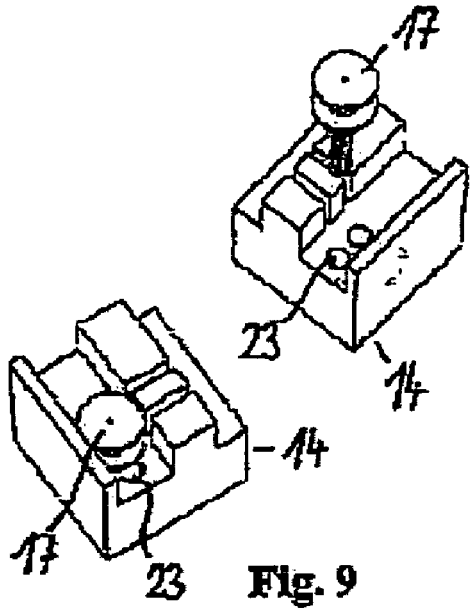
Fig. 9
Fig. 10
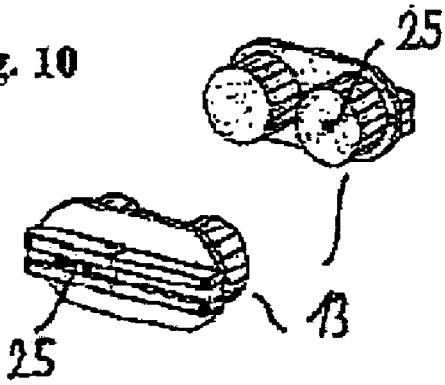
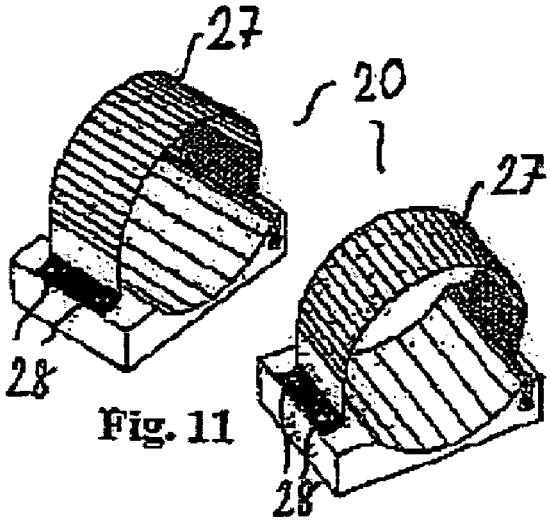
Fig. 11

ROLLER BLIND DEVICE

CROSS-REFERENCES TO RELATED APPLICATIONS

This application is a continuation of International Application No. PCT/EP2003/005383, filed May 23, 2003, the contents of which are here incorporated by reference in their entirety. The benefits of 35 USC Section 120 are here claimed.

TECHNICAL FIELD

The invention relates to a roller blind device as well as to a pane of insulating glass provided with such a roller blind device and to a correspondingly equipped window.

BACKGROUND OF THE INVENTION

The simplest kind of such roller blind devices are, e.g., the known bolt spring rollers or snap rollers. In these devices a torsional spring is arranged in the fabric shaft and an engagement mechanism for different roll-off lengths of the fabric is provided. These roller blinds require a significant amount of force for operation and frequently snap upward in an undesired manner. In addition, roller blinds with cord tensioning devices are known. In these instances the cord is rolled up onto a second shaft. The cord shaft is driven by torsional spring in the cord shaft. Even these devices require a great amount of force and exert a heavy load on the structural components.

Furthermore, generic roller blind devices constitute the subject matter of EP 0 483 528 A1 and of WO 01/53647 A1 as well as of GB 2 166 480 A. Similar devices are also disclosed in the publications EP 0 154 218 A2, EP 0 795 674 A2 and DE 4 342 977 A1 as well as DE 197 37 632. These publications describe roller blind devices with a fabric that can be wound onto a rotationally drivable fabric shaft mounted on a frame in which a pull rod is arranged on the free edge of the fabric onto which rod a force acts in the direction of the drawing off of the fabric. In the cited publications this force is generated either manually or by an electric motor and various diversions of the pull cords acting on the pull rod are provided.

The considerable insertion dimensions necessitated by the construction are disadvantageous in the known solutions. An insertion into customary double-glass windows with a 16 mm glass interval is possible with these devices, but a significant part of the original window area is lost, which reduces the incidence of light since a significant frame width is necessary for covering the functionally important parts. Moreover, a significant motor power with corresponding current consumption and corresponding heat waste, as well as large construction dimensions, are required, also necessitated by the design. Finally, these devices have a very complex mechanism and control, require many structural components and are therefore expensive, complicated, and have a high manufacturing cost.

Finally, publications DE 38 36 595 A1 and DE 9001090 U of the applicant teach windows and/or devices for darkening windows in which several rollers are connected to each other by a transmission, and a darkening web covering only part of the window can be wound ontoto each roller. These devices are operated with flexible rubber cords or springs in the pull device. They have the disadvantage that a rubber cord pull is a critical construction element, since the rubber eventually becomes brittle and tears. In the spring arrangement, the guidance around a cam is problematic.

DE 92 15 788 U1 and DE 87 03 605 U1 each show a roller blind device designed as a counterpull roller with a fabric that can be wound ontoto a rotationally drivable fabric shaft mounted on a frame and with a pull rod arranged on the free edge of the fabric onto which rod a force acts in the direction of the drawing off of the fabric. A cord reel is connected coaxially and in a prolongation of the fabric shaft to each side of the fabric shaft in such a manner that it rotates in unison with it and the free end of each cord that can be wound onto the shaft is connected to the pull rod via a cord deflection, as a result of which the cord is wound ontoto the cord reels when the fabric is pulled from the fabric shaft and vice versa. At least one spring arrangement is provided in the course of the cord or cords for adapting the length of the cord to the varying winding state of the fabric shaft and of the cord reels. This spring arrangement can be arranged inside the pull rod.

Furthermore, DE 296 09 604 U1 shows a roller blind device provided for insertion into an insulating window and comprising a laterally arranged pulley and counterweight instead of springs.

These publications have the disadvantage that two cord reels are used and, in the case of different left and right winding diameters, straight guidance of the fabric or of the pull rod is no longer possible. Furthermore, only one helical spring is provided for both cords, which significantly limits the spring travel. The described arrangements can shade only windows that are wide but not very high (e.g., automobile panes). These arrangements are not suitable for long and narrow panes, e.g., for terrace doors or roof area windows. Since the length of the usable spring travel is limited by the width of the entire device, only a correspondingly short spring travel is available when only one spring is used. Thus, however, a sufficient compensation of the different winding diameters of the fabric shaft and the cord rollers in correspondingly high windows is not possible. The pull rods described in the publications also do not make it possible to introduce two springs with added spring travel.

There is therefore the problem of further developing a generic roller blind device in such a manner that a compact construction is achieved that only minimally reduces the incidence of light through the window and that even high and narrow windows can be provided with the device. There is furthermore the problem of making available a pane of insulating glass provided with such a roller blind device and a corresponding window. These problems are solved by the characterizing features of Claim 1 and by the features of Claims 13 and 14.

BRIEF DESCRIPTION OF THE DRAWINGS

A few embodiments of the invention are described in detail in the following, with reference made to the accompanying drawings.

FIG. 8 shows a frame-connecting part for the frame according to FIGS. 1 to 3.

FIG. 9 shows another frame-connecting part for the frame according to FIGS. 1 to 3.

FIG. 10 shows the connection element of the drop rod profiles, which also serves as a cord diverter part.

FIG. 11 shows the holder for the motor of the roller blind device.

DETAILED DESCRIPTION OF THE PREFERRED EMBODIMENT

Figure 1:
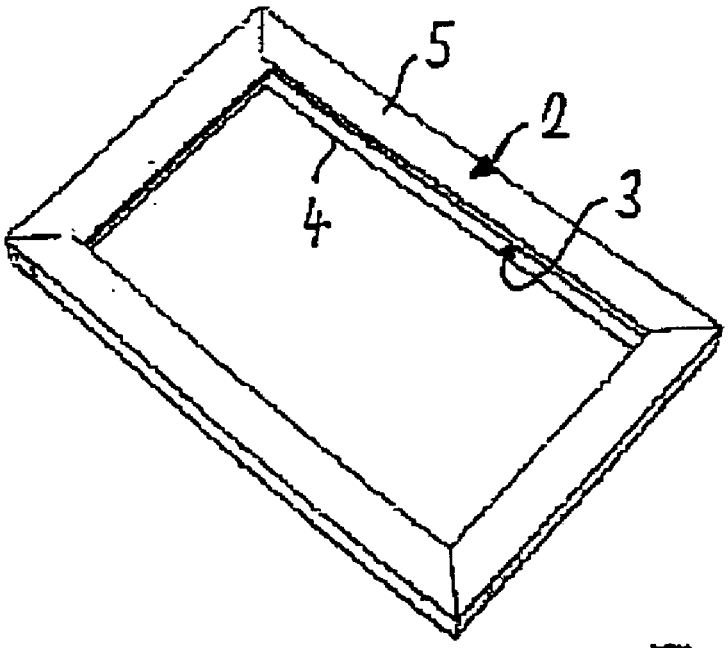
FIG. 1 shows a roller blind device inside a carrier frame.

FIG. 1 shows a frame 2 into which a roller blind device in accordance with the invention is integrated. Frame 2 consists of lower frame part 4 and upper frame part 5. Furthermore, guide slot 3 can be recognized. Frame 2 preferably consists of sheet-metal profiles or plastic profiles formed in such a manner that after assembly they enclose the mechanism, shown in the following in detail. Guide slot 3, in which the fabric and the pull rod move in a guided fashion, remains on the inside of frame 2.

Figure 2:
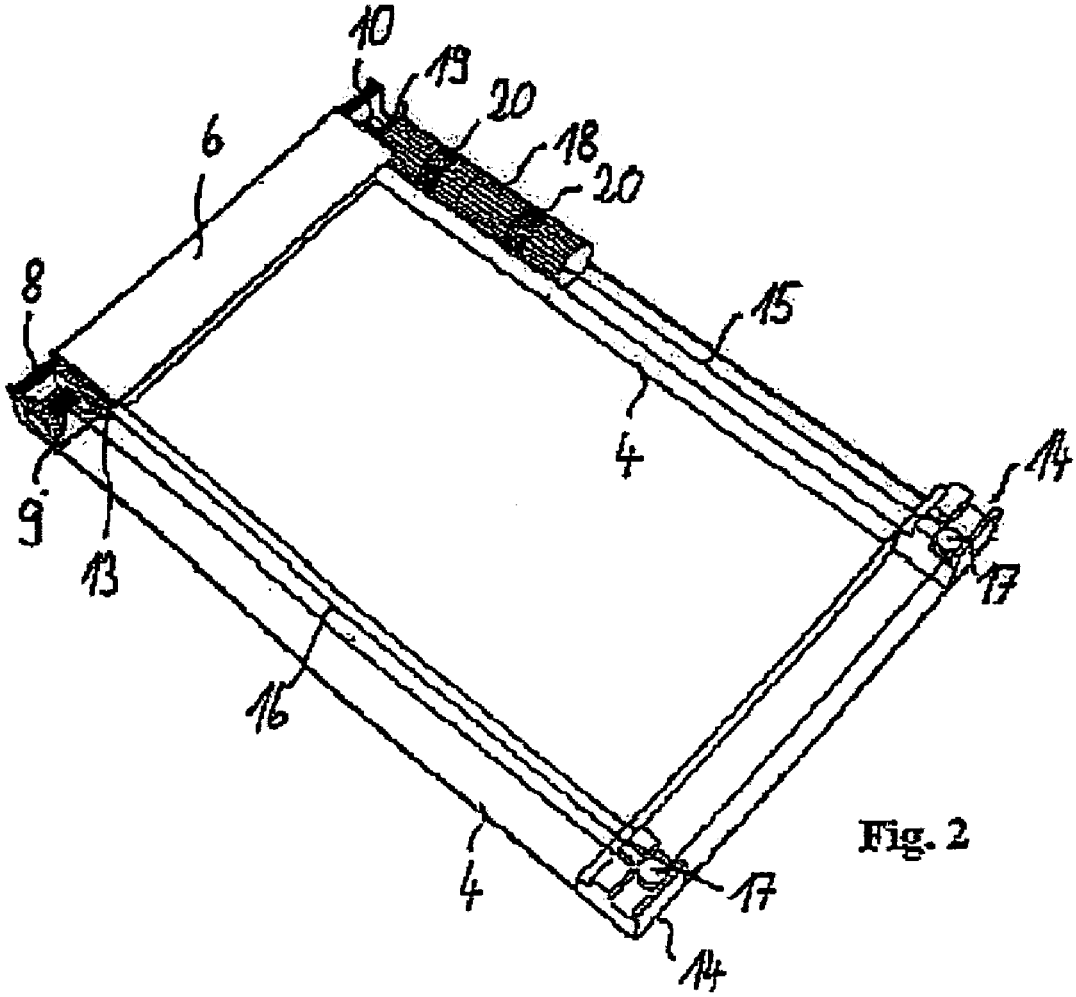
FIG. 2 shows a partial section of the roller blind device shown in FIG. 1 inside the carrier frame.

FIG. 2 shows the arrangement shown in FIG. 1 without upper frame part 5, as a result of which part of the mechanism becomes visible. Fabric 6 used for shading is wound onto a fabric shaft and diverted once over diverter shaft 8. Cord reel 9 and bevel gear 10 are connected to the fabric shaft in such a manner that they rotate in unison with it. The fabric shaft is clipped into clip holders 11 that hold frame parts 4, 5 together at the same time. Pull rod 12 is connected to the end of the fabric. The details of pull rod 12, which is designed in two parts, can best be recognized in FIG. 5. Pull rod 12 consists of two parallel rods around which fabric 6 is wound and in between which fabric 6 is clamped. Pull rod 12 is hollow inside and can therefore receive the pull cord and springs that will be discussed further below. Cord-diverter parts 13 are inserted into both ends of the pull rod, which can also be best recognized in FIG. 5. Moreover, cord-diverter parts 13 are shown in detail in FIG. 10. It can be recognized from this view that cord-diverter parts 13 serve not only to introduce the pull cord into the pull rod but also to connect the two separate rods of the pull rod, guided in parallel, by the joint insertion of both cord-diverter parts 13 into the particular adjacent ends of the two parts of pull rod 12. In addition, a U-shaped profile is set over the formation of pull rod 12 and wrapped-around fabric 6, as FIG. 6 shows. This stabilizes the structure and prevents the pull rod unit from being able to tip over upon slight spring tension. Furthermore, frame-connecting parts 14 are provided on the corners of frame 2 that also function as diverter parts for pull cords 15, 16 that are diverted around reels 17 in such a manner that that they are guided by pull rod 12 to cord reel 9. Electrical transmission motor 18, which rotates the fabric shaft by bevel gear 19, functions as drive. Motor 18 is connected to lower frame part 4 by motor holder 20 shown in detail in FIG. 11.

Figure 3:
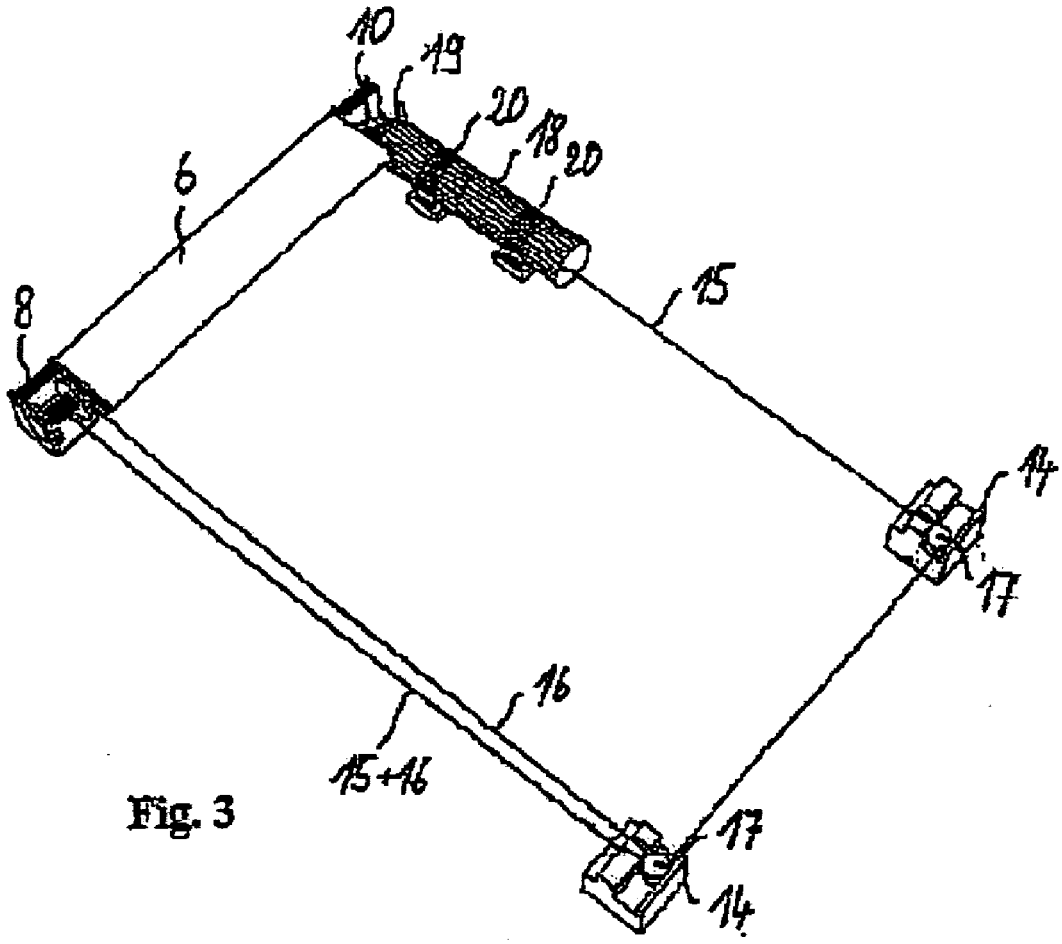
FIG. 3 shows a view in accordance with FIG. 2, but without frame elements.
Figure 4:
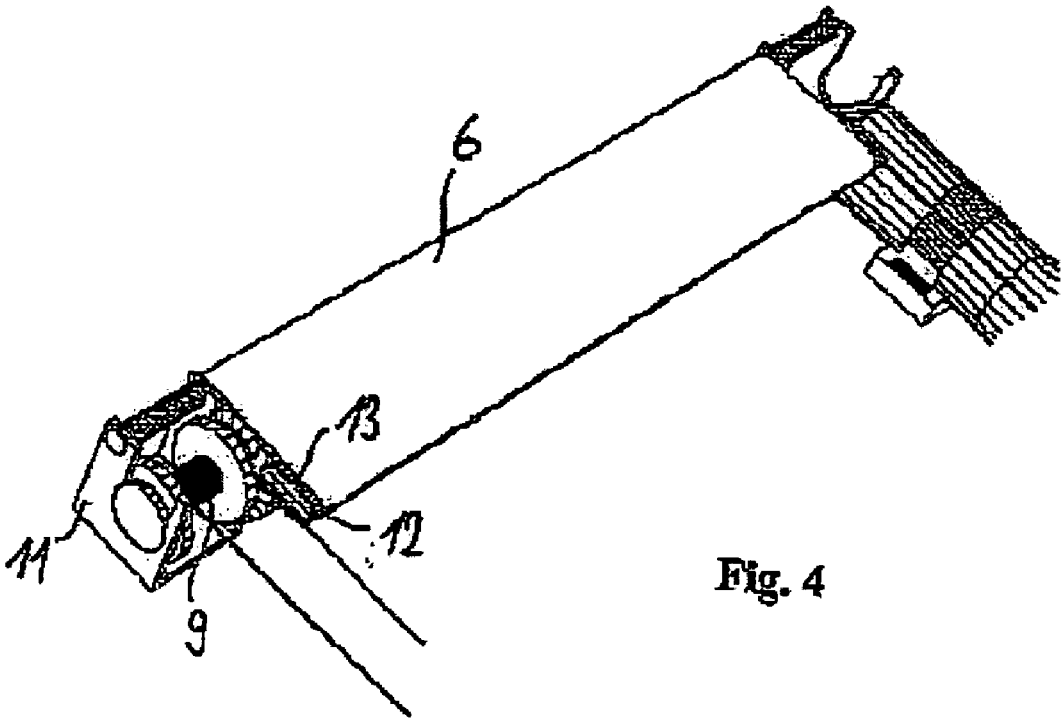
FIG. 4 shows an enlarged view of the winding area of the roller blind device shown in FIG. 3.

The entire arrangement is shown once more in FIG. 3 for the sake of a better overall view without lower frame part 4, whereas FIG. 4 shows an enlarged view of the winding area in FIG. 3. In particular, cord reel 9 and connection element 13 can be recognized more distinctly in it as can the mounting of cord reel 9 and its colinear connection with fabric shaft 7.

Figure 5:
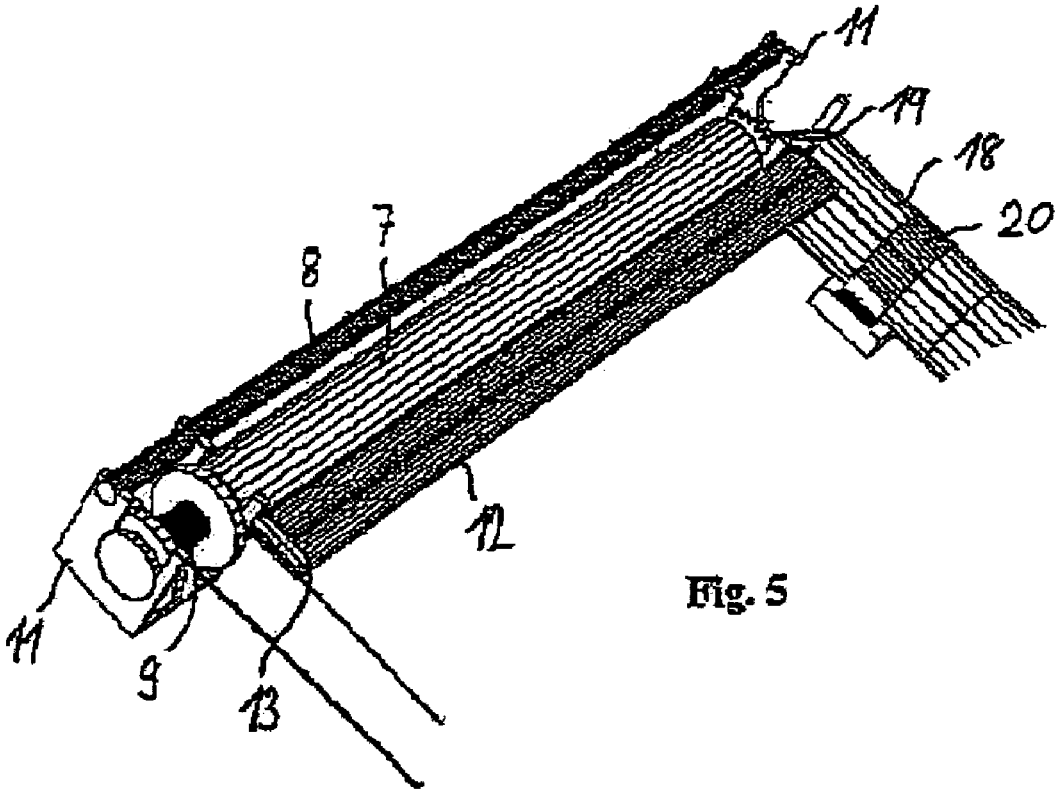
FIG. 5 shows a view according to FIG. 4 but without the fabric to be wound.
Figure 6:
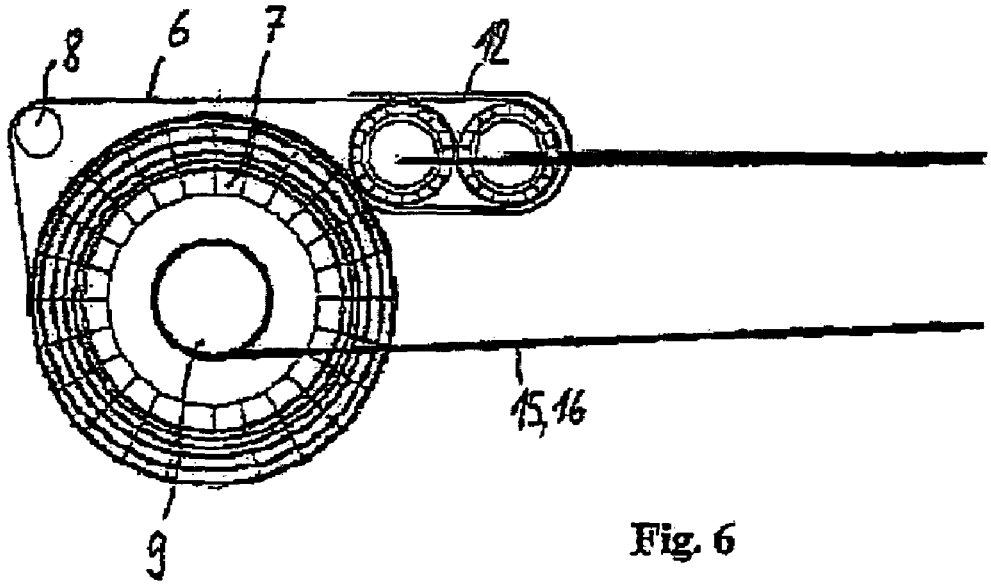
FIG. 6 shows a sectional view through the arrangement according to FIG. 4, which shows the guidance of fabric 6 as well as that of pull cords 15, 16.

Fabric shaft 7 itself is best recognized in FIG. 5, which shows a view in accordance with FIG. 4 but without fabric 6 to be wound. For the rest, the description of FIGS. 2–4 can be referred to for the description of FIG. 5. Clip holders 11 for receiving fabric shaft 7 are also shown, in particular, in FIGS. 4 and 5.

FIG. 6 shows a sectional view of FIG. 4 in which the guidance of fabric 6 as well as the guidance of pull cords 15, 16 are shown. In order to improve the clarity, the position of the cross section is not specific. It can be gathered from FIG. 6 that fabric 6 is wound onto fabric shaft 7 and is deflected downward (to the right in FIG. 6) via diverter shaft 8. Furthermore, FIG. 6 shows cord reel 9 on which pull cord 15, 16 is wound. Finally, FIG. 6 shows pull rod 12 consisting of two cylindrical, parallel and adjacent tubes around which fabric 6 is wound in the form of an "8" and between which it is clamped in. The two components (cylindrical sleeves) of pull rod 9 are held together by the already-described structural parts shown in FIG. 10 for cord diversion and pull rod connection. As has already been described above, a U-shaped profile is set over the cylindrical components of the pull rod and over the wound fabric in order to prevent a tipping over of the pull rod. It can be gathered from FIG. 6 that the effect of fabric diverter shaft 8 is that fabric 6 always lies on the same plane.

FIGS. 8–11 were already referred to in the description of FIGS. 1–6. They show details of the arrangement on an enlarged scale. In particular, FIG. 8 shows frame-connecting part 11 that receives shown fabric shaft 7 as well as diverter shaft 8 (not shown) in catch tabs provided to this end by clipping them in. FIG. 8 shows frame-connecting part 11 with and without clipped-in fabric shaft 7 and cord reel 9. FIG. 9 shows the further frame-connecting part 14 also in two views with reels 17 of which reel 17 is half pulled out in one view. Reels 17 function as described for cord diverting. Frame-connecting parts 14 to be placed in the lower left and the lower right corners of the frame are mirror-symmetrical and have two bores 23 into which reels 17 can be inserted. The roller blind device can be driven left or right by inserting reels 17 into the one or the other bore.

FIG. 10 shows connection element 13 for the two components of pull rod 12. The pins on each connection element 13 engage in the inner sides of the ends of the elements of the pull rod, thus nonpositively connecting both components. This also ensures that fabric 6 is clamped between both elements of pull rod 12. However, connection elements 13 also serve to divert cords 15,16 into the inside of pull rod 12, during which the cord is guided through bores 25.

FIG. 11 shows holder 20 for motor 18 in detail. This holder 20 consists of a "shoe" connected to lower frame part 14, into which motor 18 can be inserted precisely. Clamp bracket 27 is placed over the motor body and tightened and locked by screws 28. As a result, motor 18 can be shifted on its longitudinal side as needed by loosening screws 28 and the bevel gears can be brought into exact engagement with each other.

Figure 7:
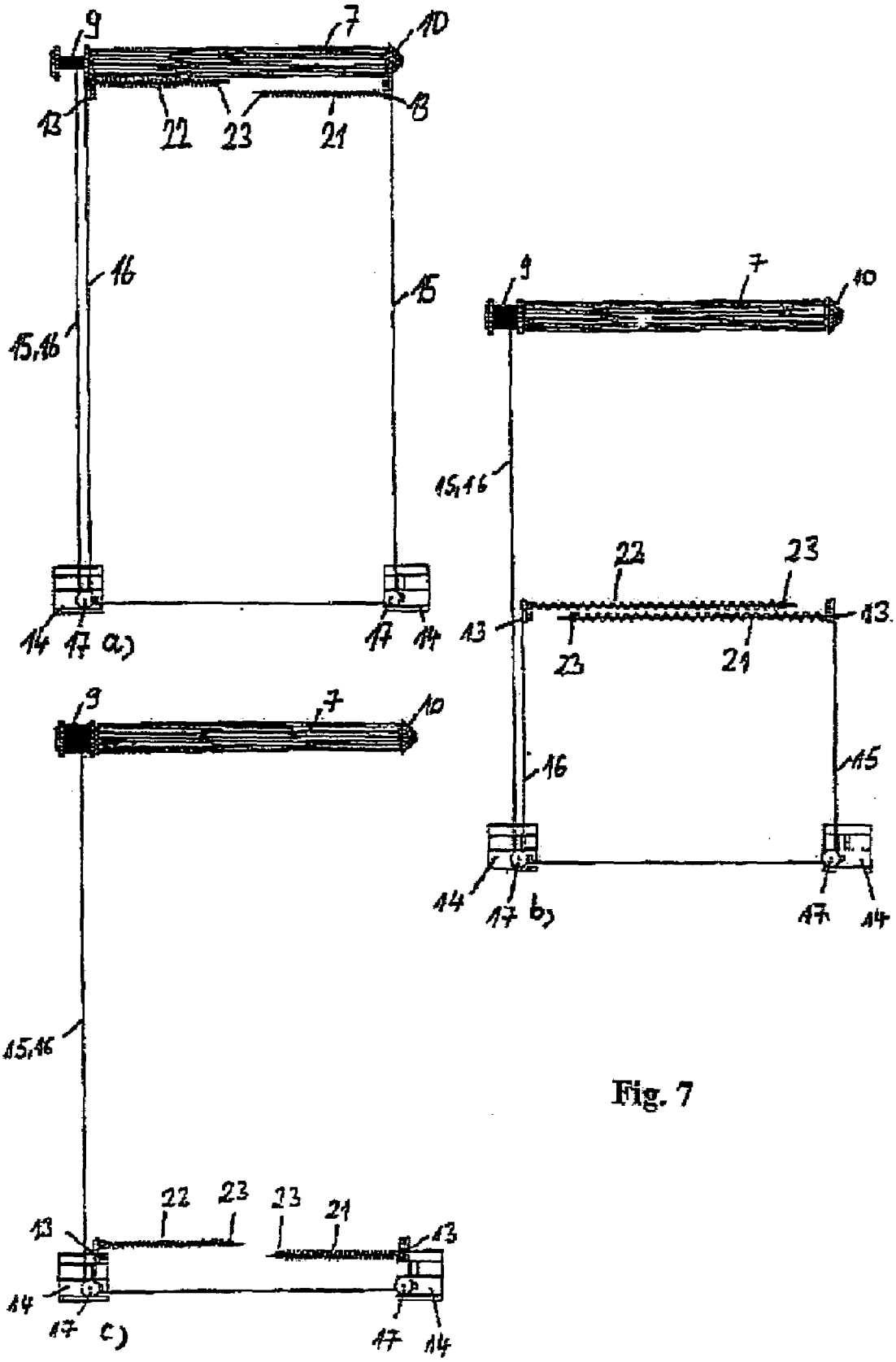
FIG. 7 shows a schematic front view of the roller blind device in the three winding states of (a) rolled-up fabric, (b) half-rolled-up fabric, (c) rolled-down fabric.

The operation of a first embodiment of the invention can best be recognized from the three partial figures of FIG. 7 which show schematic front views of the roller blind device in three winding states. Partial figure (a) shows the state with completely rolled-up fabric 6, partial figure (b) with half-rolled-up or half-rolled-down fabric 6 and partial figure (c) shows the state with completely rolled-down fabric 6. The same manner of presentation applies to the other embodiments described further below. FIG. 7 and the subsequent figures show the method of operation without fabric 6 and drop rod 12. Drop rod 12 is located between shown cord-diverter parts 13.

In FIG. 7 pull cords 15, 16 are run through diverter parts 13 and springs 21, 22 located in both parts of pull rod 12. Thickened part 23 is on the ends of each pull cord 15, 16 with which part the particular pull cord 15 or 16 is supported against the end of the particular spring 21 or 22 and the pull cord cannot be drawn through the spring. Springs 21, 22 are prestressed, that is, under pressure. When the roller blind device opens or closes, a different amount of fabric 6 and cord 15, 16 is permanently rolled up or down to a middle state, as is indicated in partial figure (b), since as the winding-off of the fabric (from (a) to (c)) increases, the outside diameter of fabric shaft 7 decreases, whereas at the same time, the outside diameter of cord shaft 9 increases via the wound-up cords 15, 16. Partial figure (b) shows that the outside diameter of fabric shaft 7 is equal to the outside diameter of cord shaft 9. In this transitional state, springs 21, 22 are maximally expanded since the maximum free length of cords 15 and 16 is present here. During the further transition from partial figure (b) to partial figure (c) springs 21, 22 are compressed again by the increasing outside diameter of cord reel 9 and the further decreasing outside diameter of fabric shaft 7. Therefore, the entire arrangement is capable of compensating the different winding states between fabric shaft 7 and cord shaft 9 by springs 21, 22 at any given time, without pull cords 15, 16 sagging or being tightened too much. Consequently, the device can also be brought into any desired angle of inclination, e.g., in roof-area windows,since a uniform tension of fabric 6 and cords 15, 16 is always present.

Figure 12:
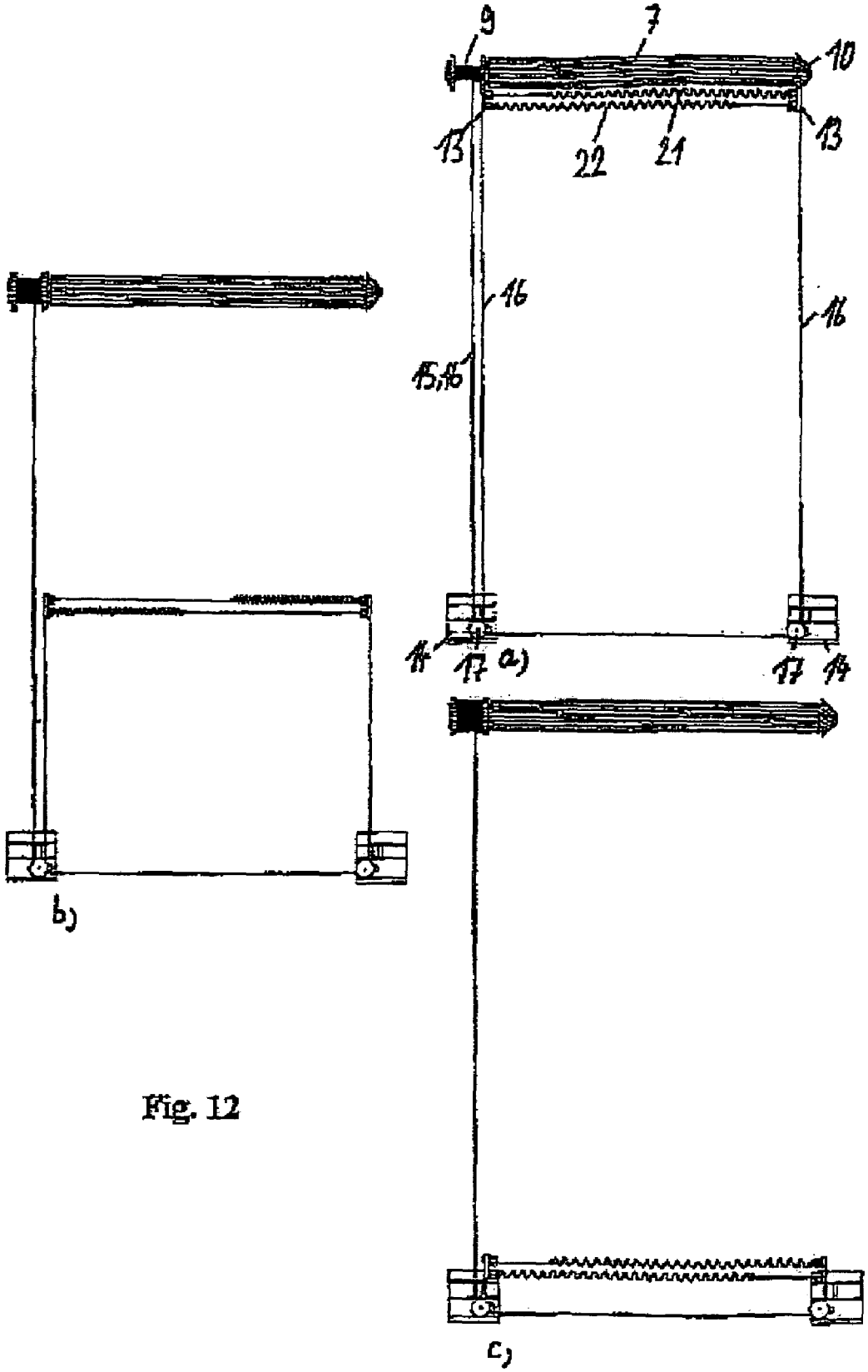
FIG. 12 shows a variant of the embodiment according to FIG. 7 in which bolt springs are used instead of pressure springs.

The partial figures (a), (b) and (c) of FIG. 12 show an embodiment similar to that of FIG. 7, in which, however, bolt springs are used instead of pressure springs. In distinction from the use of pressure springs, in this case connections must be created between bolt springs 21 and 22 and cord-diverter parts 13 in order to hold springs 21 and 22 fast. In distinction from the embodiment according to FIG. 7, the springs have their minimum length in the middle position (b), whereas they have their maximum length in the end positions (a) and (c).

In a particular embodiment of the invention that is possible with all described variants, the described roller blind device with an appropriately profiled frame, such as the one shown in FIG. 1 can be used as replacement for the so-called glass strips. The glass strips of a window are the strips with which the glass is held in the frame. These glass strips can be removed and replaced by a roller blind device in accordance with the invention, or its frame, which achieves a shallow insertion depth and low overall height and, in addition, a maximum incidence of light.

The glass strip can just as well be replaced by an angled profile shaped in such a manner that it receives the standard frame of the described roller blind device by clipping it in.

Since the device has a self-supporting frame it can also be mounted as an independent roller blind in the window rabbet by clamping or screwing.

What is claimed is:

1. A roller blind device comprising:

a fabric positionable about a rotationally drivable fabric shaft supported on a frame;

a hollow pull rod including first and second ends and arranged on a free edge of the fabric on which a force acts in a direction of the drawing off of the fabric, from the fabric shaft, wherein the hollow pull rod has two parallel cylindrical rod parts;

a cord reel connected to the fabric shaft coaxially and in a prolongation of the fabric shaft in such a manner that the cord reel rotates in unison with the fabric shaft;

at least one cord diverter part positioned on the first or second end of the hollow pull rod;

at least one cord having a first end connected to the cord reel and a second free end positioned about the at least one cord-diverter part, as a consequence of which the at least one cord is wound onto the cord reel during the pulling off of the fabric from the fabric shaft; and at least one spring arrangement, including first and second helical springs, is provided inside the hollow pull rod and supported on the at least one cord diverter part, wherein the second free end of the at least one cord is connected to the at least one spring arrangement, such that the least one spring arrangement maintains a tension on the at least one cord, wherein the at least one cord includes first and second cords, the second free end of the first cord runs to the first end of the hollow pull rod and is connected to the first helical spring and the second free end of the second cord runs to the second end of the hollow pull rod and is connected to the second helical spring, and each of the two parallel cylindrical rod parts of the hollow pull rod receives one of the first and second helical springs.

2. The roller blind device according to claim 1, wherein the first and second cords run laterally into the hollow pull rod one each through the first and second helical springs, wherein the first and second helical springs are arranged in the hollow pull rod and prestressed under pressure, and the first and second cords each comprise a thickened area on the second free ends whose expansion corresponds at least to the diameter of the first and second helical springs.

3. The roller blind device according to claim 1, wherein the first and second cords run laterally into the hollow pull rod and are fastened inside the hollow pull rods to an end of one of the first or second helical spring, wherein the first and second helical springs are prestressed under traction and associated with only one cord, an opposite end of the first and second helical springs is fastened to the hollow pull rod.

4. A pane of insulating glass comprising two glass panes proximally position to define an inner space between them, wherein a roller blind device as set forth in claim 1 is arranged within the inner space.

5. A window comprising a frame and at least one pane of glass, wherein a housing of a roller blind device in accordance with claim 1 fixes the pane of glass in the frame.

* * * * *